US010871135B2

(12) United States Patent
Kato et al.

(10) Patent No.: US 10,871,135 B2
(45) **Date of Patent: *Dec. 22, 2020**

(54) INTERNAL COMBUSTION ENGINE AND METHOD FOR MANUFACTURING INTERNAL COMBUSTION ENGINE

(71) Applicant: TOYOTA JIDOSHA KABUSHIKI KAISHA, Toyota (JP)

(72) Inventors: Hiroya Kato, Nisshin (JP); Tomihisa Tsuchiya, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/374,786

(22) Filed: Apr. 4, 2019

(65) Prior Publication Data

US 2019/0331077 A1 Oct. 31, 2019

(30) Foreign Application Priority Data

Apr. 26, 2018 (JP) ..... 2018-084995

(51) Int. Cl.

| | |
|---|---|
| ***F02B 77/00*** | (2006.01) |
| ***F02M 59/10*** | (2006.01) |
| ***F01L 1/047*** | (2006.01) |
| ***F01L 1/46*** | (2006.01) |
| ***F02B 77/11*** | (2006.01) |

(Continued)

(52) U.S. Cl.

CPC ..... *F02M 59/102* (2013.01); *F01L 1/047* (2013.01); *F01L 1/46* (2013.01); *F02B 77/11* (2013.01); *F02M 59/027* (2013.01); *F02M 59/445* (2013.01); *F02M 59/48* (2013.01); *F02M 2700/05* (2013.01)

(58) Field of Classification Search

CPC .. F02M 39/02; F02M 2200/18; B29C 43/003; B29C 43/18; B29K 2021/00; B29K 2307/04; B29L 2031/7496; B29L 2031/768

USPC ..... 123/198 R, 198 E, 198 C

See application file for complete search history.

(56) References Cited

U.S. PATENT DOCUMENTS

| | | | | |
|---|---|---|---|---|
| 10,279,678 | B2 | 5/2019 | Mushiga et al. | |
| 2008/0217089 | A1 * | 9/2008 | Takahata ..... | F02M 59/102 180/271 |

(Continued)

FOREIGN PATENT DOCUMENTS

| | | | |
|---|---|---|---|
| DE | 102008042626 | A1 | 12/2009 |
| JP | H06-67855 | U | 9/1994 |

(Continued)

OTHER PUBLICATIONS

Sep. 26, 2018 Office Action issued in U.S. Appl. No. 15/875,351.
"Holley Electric Fuel Pump Q's". Jalopy Journal. Jun. 24, 2008.

*Primary Examiner* — John Kwon
(74) *Attorney, Agent, or Firm* — Oliff PLC

(57) ABSTRACT

A high-pressure fuel pump and a protector are coupled to an outer side of an engine body of an internal combustion engine. A wall plate surrounds the high-pressure fuel pump to protect the high-pressure fuel pump. A cover of the high-pressure fuel pump has a flange. The engine body has a mounting surface. The bottom plate and the flange are fastened to the mounting surface by a bolt with the bottom plate held between the flange and the mounting surface.

8 Claims, 5 Drawing Sheets

(51) Int. Cl.

| | |
|---|---|
| ***F02M 59/02*** | (2006.01) |
| ***F02M 59/44*** | (2006.01) |
| ***F02M 59/48*** | (2006.01) |

(56) References Cited

U.S. PATENT DOCUMENTS

| | | | | |
|---|---|---|---|---|
| 2009/0130417 | A1 | 5/2009 | Maeda et al. | |
| 2015/0337784 | A1 | 11/2015 | Ishikawa et al. | |
| 2018/0208051 | A1* | 7/2018 | Mushiga | B60K 15/01 |
| 2018/0306151 | A1* | 10/2018 | Laepple | F02M 59/48 |
| 2019/0331075 | A1* | 10/2019 | Kato | F02M 39/02 |
| 2019/0331078 | A1* | 10/2019 | Kato | F02M 59/48 |
| 2020/0025065 | A1* | 1/2020 | Ichikawa | F02B 77/08 |

FOREIGN PATENT DOCUMENTS

| | | | |
|---|---|---|---|
| JP | 2004-360581 | A | 12/2004 |
| JP | 2005-036710 | A | 2/2005 |
| JP | 2007-321656 | A | 12/2007 |
| JP | 2010-138729 | A | 6/2010 |
| JP | 2014-101807 | A | 6/2014 |
| JP | 2015-224558 | A | 12/2015 |
| KR | 10-2011-0034334 | A | 4/2011 |

* cited by examiner

INTERNAL COMBUSTION ENGINE AND METHOD FOR MANUFACTURING INTERNAL COMBUSTION ENGINE

BACKGROUND

1. Field

The following description relates to an internal combustion engine including a high-pressure fuel pump and a method for manufacturing the internal combustion engine.

2. Description of Related Art

Japanese Laid-Open Patent Publication No. 2014-101807 discloses an internal combustion engine including a protector that protects a high-pressure fuel pump. The protector and the high-pressure fuel pump are fastened to the head cover in the engine body by bolts.

When the engine is running, heat is generated. The heat is transmitted from the engine body to the high-pressure fuel pump, which is coupled to the engine body. When the heat supplied in this manner increases the temperature of the high-pressure fuel pump, the fuel is warmed. As a result, bubbles will be easily produced in the fuel supply passage.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Examples of the present disclosure will now be described.

Example 1: An internal combustion engine according to one aspect of the present disclosure includes a high-pressure fuel pump, a plastic protector including a bottom plate and a wall plate extending upward from the bottom plate, and an engine body. The high-pressure fuel pump and the protector are coupled to an outer side of the engine body. The wall plate surrounds the high-pressure fuel pump to protect the high-pressure fuel pump. The high-pressure fuel pump includes a fuel chamber and a cover that surrounds the fuel chamber. The cover has a flange. The engine body has a mounting surface. The bottom plate and the flange are fastened to the mounting surface by a bolt with the bottom plate held between the flange and the mounting surface.

Generally, plastic is less thermally conductive than metal. In the above-described structure, the plastic protector is held between the mounting surface, which is located closer to the engine body, and the flange of the high-pressure fuel pump. Accordingly, the plastic protector serves as a heat-shielding layer. Thus, as compared to when, for example, the flange is directly coupled to the mounting surface, temperature increases in the high-pressure fuel pump are limited. This limits situations in which bubbles are easily produced in the fuel supply passage by the heat generated when the engine is running.

Example 2: In the internal combustion engine according to example 1, the bottom plate includes a bolt insertion portion through which the bolt is inserted. The bolt insertion portion is held between the flange and the mounting surface. The bolt insertion portion is configured by a metal collar.

When plastic members are fastened by bolts and continue to be used under a high-temperature environment, the plastic members may undergo creep deformation. When the creep deformation occurs, the fastening force produced by the bolts becomes low, thereby facilitating loosening of the bolts. In the above-described structure, the metal collars, which are less likely to undergo creep deformation than plastic, configure the bolt insertion portions of the bottom plate where load resulting from the fastening particularly tends to act. This limits decreases in the fastening force that result from creep deformation.

Example 3: In the internal combustion engine according to example 1 or 2, the protector is made of a fiber reinforced plastic.

The protector, which protects the high-pressure fuel pump with the wall plate, needs to have a high strength. A fiber reinforced plastic is a material in which fiber is mixed with plastic lighter than metal to increase the strength of the material, having a higher specific strength than metal. Thus, the above-described structure allows the lightweight, high-strength protector to protect the high-pressure fuel pump. This reduces the weight of the internal combustion engine.

Example 4: In the internal combustion engine according to example 3, the fiber reinforced plastic is a carbon fiber reinforced plastic.

Among fiber reinforced plastics, a carbon fiber reinforced plastic particularly has a high specific strength. Thus, the above-described structure allows the weight of the internal combustion engine to be further reduced.

Example 5: In the internal combustion engine according to any one of examples 1 to 4, the high-pressure fuel pump is a plunger pump driven by a camshaft of the internal combustion engine. The engine body includes a metal cam cap. The mounting surface is arranged on the cam cap. The high-pressure fuel pump and the protector are fastened to the mounting surface.

The plunger pump, which is driven by the camshaft, is often fastened to the mounting surface on the metal cam cap. The metal cam cap is proximate to the cylinder head, which configures the combustion chamber for the internal combustion engine. Thus, the temperature of the cam cap is increased by the heat generated when the engine is running. Thus, the above-described structure is effective to limit situations in which bubbles are easily produced in the fuel supply passage by the heat generated when the engine is running. That is, limiting temperature increases in the high-pressure fuel pump by holding the bottom plate of the protector between the mounting surface and the flange is effective to limit the generation of bubbles in the fuel supply passage.

Example 6: A method for manufacturing an internal combustion engine is provided. The method includes preparing a high-pressure fuel pump including a fuel chamber and a cover that surrounds the fuel chamber, a flange being arranged on the cover, preparing a plastic protector including a bottom plate and a wall plate extending upward from the bottom plate, the wall plate surrounding around the high-pressure fuel pump to protect the high-pressure fuel pump, coupling the high-pressure fuel pump and the protector to an outer side of an engine body of the internal combustion engine, arranging a mounting surface on the engine body, and fastening the bottom plate and the flange to the mounting surface by a bolt with the bottom plate held between the flange and the mounting surface.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An internal combustion engine 100 according to an embodiment of the present disclosure will now be described with reference to FIGS. 1 to 4.

Figure 1:
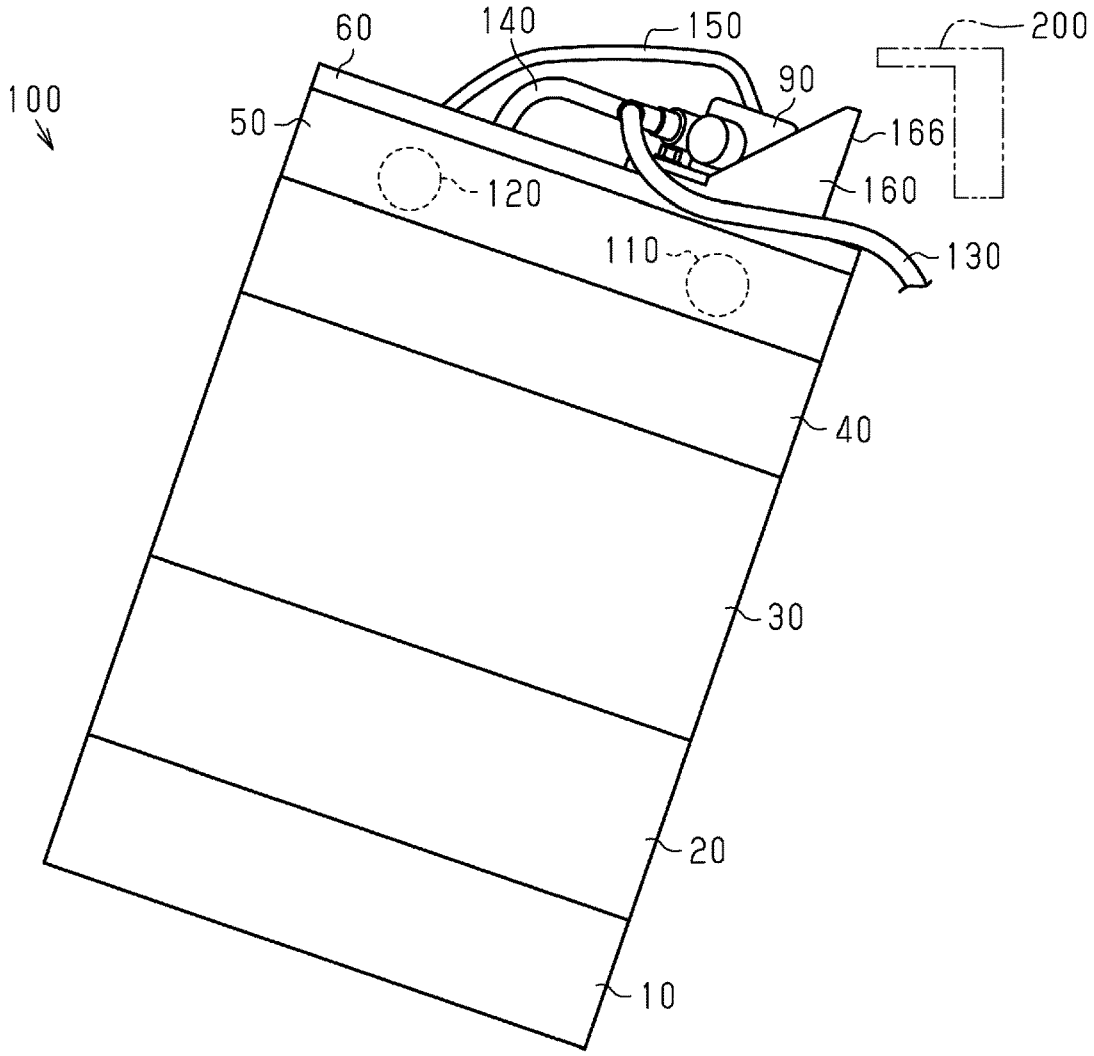
FIG. 1 is a schematic view illustrating where a high-pressure fuel pump is installed in an internal combustion engine according to an embodiment of the present disclosure.

As shown in FIG. 1, a crankcase 20 is coupled to the lower part of a cylinder block 30 of the internal combustion engine 100. An oil pan 10 is coupled to the lower end of the crankcase 20. A cylinder head 40 is coupled to the upper end of the cylinder block 30. A cam housing 50 is coupled to the upper end of the cylinder head 40. A cylinder head cover 60 is coupled to the upper end of the cam housing 50. The oil pan 10, the crankcase 20, the cylinder block 30, the cylinder head 40, the cam housing 50, and the cylinder head cover 60 are assembled to configure the engine body of the internal combustion engine 100.

A high-pressure fuel pump 90 and a protector 160 are coupled to the upper part of the engine body. That is, the high-pressure fuel pump 90 is located at the upper part of the cylinder head cover 60. The high-pressure fuel pump 90 compresses fuel supplied through a fuel supply pipe 130 to supply an in-cylinder fuel injection valve with high-pressure fuel through a high-pressure fuel pipe 150.

The cam housing 50 accommodates an intake camshaft 120 and an exhaust camshaft 110. The high-pressure fuel pump 90 is a plunger pump that is driven by the exhaust camshaft 110 and coupled to the upper side of the exhaust camshaft 110.

FIG. 1 shows the position of the internal combustion engine 100 installed in a vehicle. In FIG. 1, the left side corresponds to the front side of the vehicle, and the right side corresponds to the rear side of the vehicle. The internal combustion engine 100 is installed in the vehicle with the upper part of the internal combustion engine 100 inclined rearward such that the upper side of the internal combustion engine 100 is located rearward. As shown by the long dashed double-short dashed line, a cowl top panel 200 is arranged rearward from the high-pressure fuel pump 90 with the internal combustion engine 100 installed in the vehicle. The cowl top panel 200 is one of the components that configure the vehicle body.

When the vehicle collides with an object from the front, the collision deforms the front part of the vehicle, causing the internal combustion engine 100 to move rearward. This causes the protector 160 to abut the cowl top panel 200 and thus limits the collision of the high-pressure fuel pump 90 with the cowl top panel 200. That is, the protector 160 is arranged to protect the high-pressure fuel pump 90.

Figure 2:
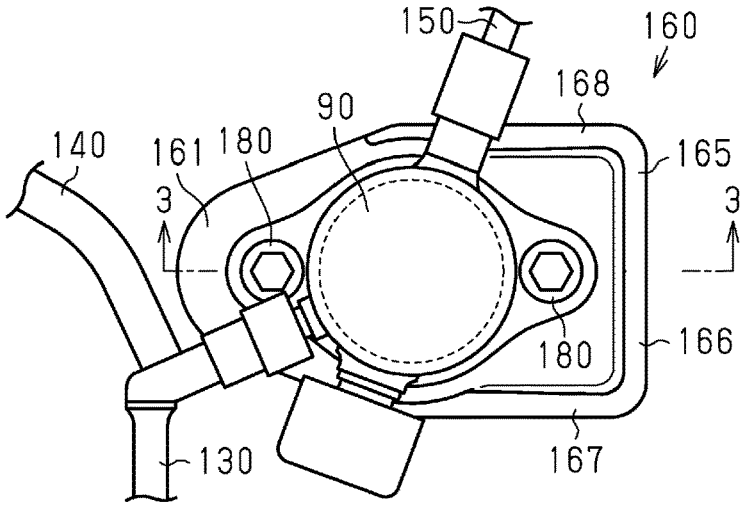
FIG. 2 is a plan view of the high-pressure fuel pump in the internal combustion engine shown in FIG. 1.

As shown in FIG. 2, at the front side of the high-pressure fuel pump 90, the fuel supply pipe 130 branches into a pipe connecting to the high-pressure fuel pump 90 and a low-pressure fuel pipe 140. Fuel that has not been supplied from the fuel supply pipe 130 to the high-pressure fuel pump 90 is supplied to a port fuel injection valve through the low-pressure fuel pipe 140.

Figure 3:
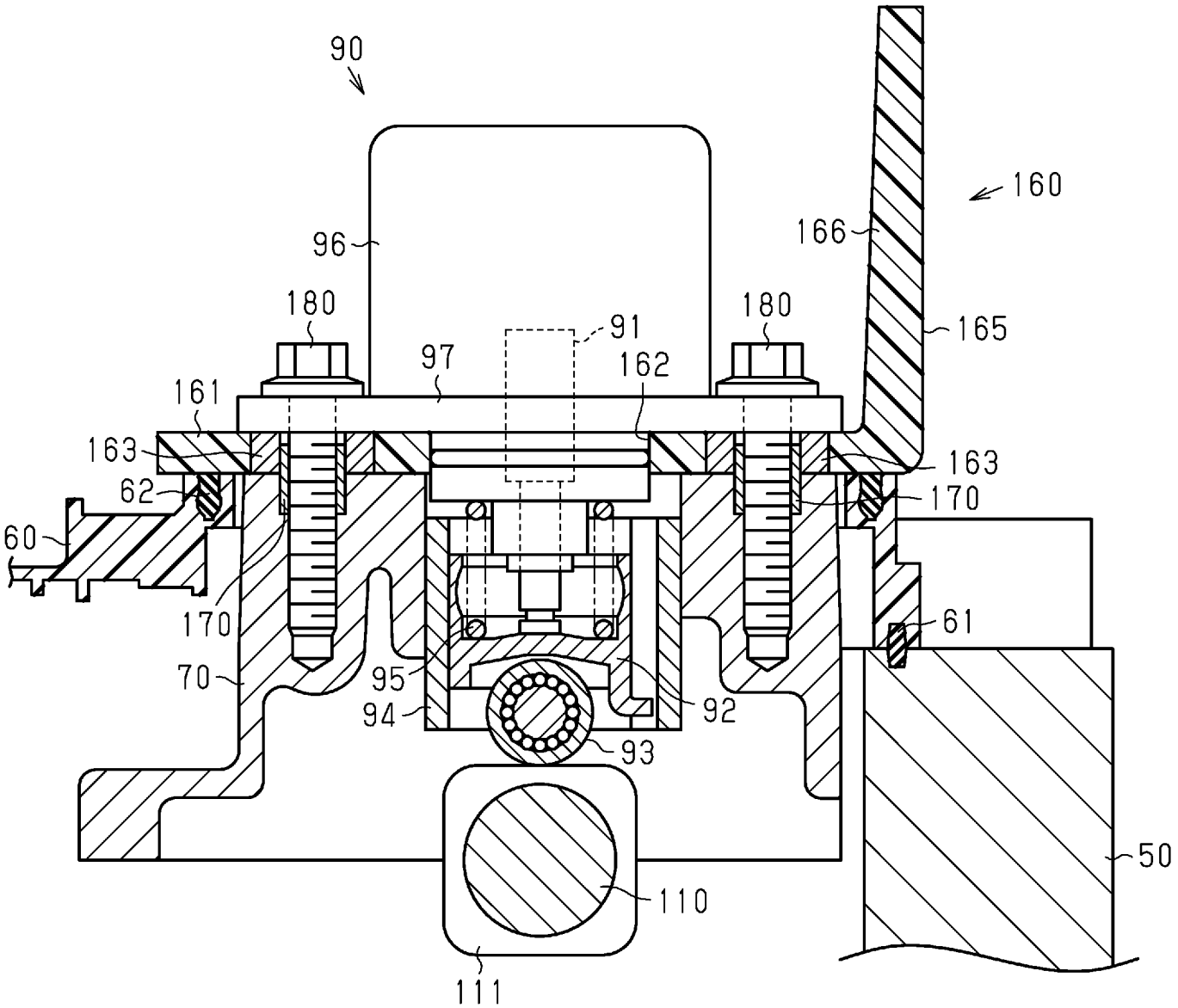
FIG. 3 is a cross-sectional view taken along line 3-3 in FIG. 2.
Figure 4:
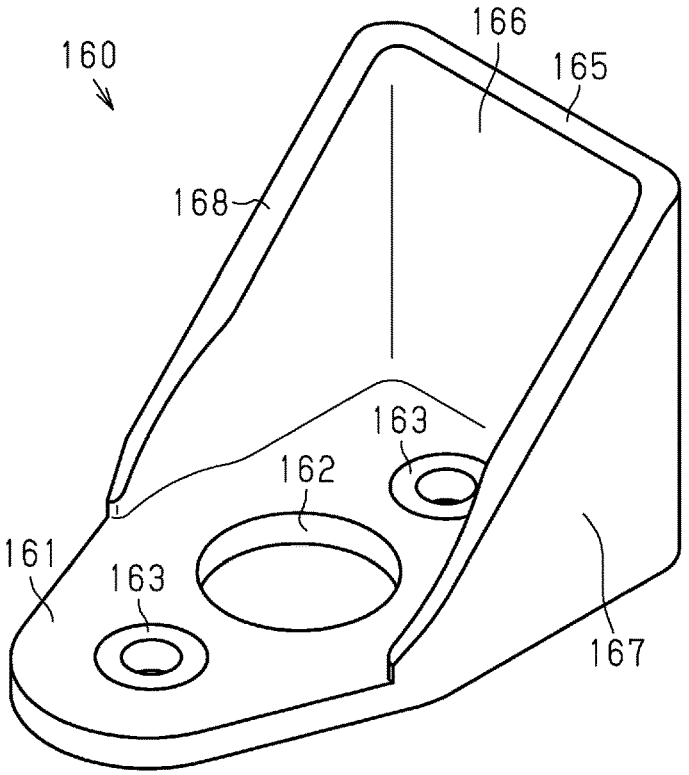
FIG. 4 is a perspective view of the protector shown in FIG. 3.

As shown in FIGS. 2 to 4, the protector 160 includes a bottom plate 161 and a wall plate 165 extending upward from the bottom plate 161.

As shown in FIG. 4, the bottom plate 161 has a through-hole 162. As shown in FIG. 3, a plunger 91 of the high-pressure fuel pump 90 is inserted through the through-hole 162 into the cam housing 50.

As shown in FIG. 3, the cam housing 50 includes a metal cam cap 70. In the cam housing 50, the exhaust camshaft 110 is rotationally supported by the cam cap 70 placed over the exhaust camshaft 110 from above.

The exhaust camshaft 110 includes a cam 111 that drives the high-pressure fuel pump 90. The cam 111 abuts a roller 93 on a lifter 92 of the high-pressure fuel pump 90. The cam cap 70 accommodates the lifter 92. A lifter guide 94 that guides vertical movement of the lifter 92 is fitted to the cam cap 70. The distal end of the plunger 91 is coupled to the lifter 92, and the plunger 91 and the lifter 92 are pushed down by a spring 95 toward the cam 111.

The cylinder head cover 60 opens such that the upper surface of the cam cap 70 is exposed. The protector 160 and the high-pressure fuel pump 90 are provided to close the opening of the cylinder head cover 60. A first oil seal 61 is fitted to a sealed portion of the cylinder head cover 60 and the cam housing 50, and a second oil seal 62 is fitted to a sealed portion of the bottom plate 161 of the protector 160 of the cylinder head cover 60.

The protector 160 is a plastic molding component made of a carbon fiber reinforced plastic. As shown in FIGS. 3 and 4, two metal collars 163 having a flat tubular shape are embedded into the bottom plate 161. In the protector 160, such a structure is achieved through insert-molding.

Two tubular retainers 170 are fitted to the upper surface of the cam cap 70. The two retainers 170 are respectively inserted through the two collars 163 so that the protector 160 is positioned with respect to the cam cap 70. With the protector 160 positioned in such a manner, bolts 180 are used to fasten the protector 160 and the high-pressure fuel pump 90 to the mounting surface of the cam cap 70. More specifically, the bottom plate 161 of the protector 160 is held between a flange 97 arranged on the cover 96 of the high-pressure fuel pump 90 and the mounting surface of the cam cap 70. With the bottom plate 161 held between the flange 97 and the mounting surface in such a manner, the flange 97 of the high-pressure fuel pump 90 and the bottom plate 161 of the protector 160 are fastened to the mounting surface of the cam cap 70 by the bolts 180 to fix the protector 160 to the cam cap 70. This allows the high-pressure fuel pump 90 to be fastened to the outer side of the engine body with the plastic protector 160 held between the cam cap 70 and the flange 97 arranged on the cover 96, which surrounds a fuel chamber of the high-pressure fuel pump 90.

As shown in FIG. 3, the diameter of each collar 163 is slightly larger than the diameter of the head of the corresponding bolt 180.

As shown in FIGS. 2 and 4, the wall plate 165 of the protector 160 includes a front wall 166, a first side wall 167, and a second side wall 168. The front wall 166 is located at the rear side. As shown in FIG. 1, the front wall 166 is opposed to the cowl top panel 200. The first side wall 167 and the second side wall 168 respectively extend frontward from the opposite ends of the front wall 166.

As shown in FIG. 4, the first side wall 167 and the second side wall 168 become lower toward the front side. As shown in FIG. 2, this allows the first side wall 167, the second side wall 168, and the front wall 166 to surround the cover 96 of the high-pressure fuel pump 90 while avoiding interference with the fuel pipes.

The arrangement of the first side wall 167 and the second side wall 168 limits deformation of the front wall 166 in the front-rear direction of the vehicle, thereby increasing the strength of the protector 160.

The operation of the present embodiment will now be described.

When the vehicle collides with an object from the front so that the front part of the vehicle deforms rearward, the deformation of the front part of the vehicle causes the internal combustion engine 100 to move rearward. In the internal combustion engine 100, the front wall 166 of the protector 160 is arranged rearward from the high-pressure fuel pump 90. Thus, when the internal combustion engine 100 moves rearward, the front wall 166 abuts the cowl top panel 200, thereby preventing the high-pressure fuel pump 90 from colliding with the cowl top panel 200. That is, since the high-pressure fuel pump 90 is protected by the protector 160, the high-pressure fuel pump 90 is prevented from directly colliding with the cowl top panel 200.

Generally, plastic is less thermally conductive than metal. In the internal combustion engine 100, the plastic protector 160 is held between the mounting surface, which is located closer to the engine body, and the flange 97 of the high-pressure fuel pump 90. Accordingly, the plastic protector 160, particularly, the bottom plate 161 serves as a heat-shielding layer.

The advantages of the present embodiment will now be described.

(1) The bottom plate 161 serves as a heat-shielding layer. Thus, as compared to when, for example, the flange 97 is directly coupled to the mounting surface, temperature increases in the high-pressure fuel pump 90 are limited. This limits situations in which bubbles are easily produced in the fuel supply passage by the heat generated when the engine is running.

(2) The protector 160 is mostly made of a carbon fiber reinforced plastic, which has a higher specific strength than metal. Thus, the internal combustion engine 100 is lighter than, for example, an internal combustion engine in which a metal protector is arranged and the high-pressure fuel pump 90 is protected by the metal protector.

(3) Utilizing the elasticity of the plastic of which the protector 160 is made, vibration that occurs when the high-pressure fuel pump 90 is running can be dampened. This reduces the operating noise of the high-pressure fuel pump 90 emitted into the air.

(4) When plastic members are fastened by bolts and continue to be used under a high-temperature environment, the plastic members undergo creep deformation. When the creep deformation occurs, the fastening force produced by the bolts becomes low, thereby facilitating loosening of the bolts. In the internal combustion engine 100, the metal collars 163 configure bolt insertion portions of the bottom plate 161 that are held between the mounting surface of the cam cap 70 and the flange 97 and through which the bolts 180 are inserted. That is, the metal collars 163, which are less likely to undergo creep deformation than plastic, configure the bolt insertion portions of the bottom plate 161 where load resulting from the fastening particularly tends to act. This limits decreases in the fastening force that result from creep deformation.

When more parts are made of metal in the bottom plate 161, the effect of heat shielding by the bottom plate 161 becomes smaller. In the internal combustion engine 100, the diameter of each collar 163 is slightly larger than the diameter of the head of the corresponding bolt 180. This effectively limits creep deformation and limits loss of the heat-shielding effect resulting from the arrangement of the metal collar 163.

The present embodiment may be modified as described below. The present embodiment and the following modifications may be implemented in combination with each other as long as technical contradiction does not occur.

The protector 160 does not necessarily have to protect the high-pressure fuel pump 90 from collision with the cowl top panel 200. The components of the vehicle that are likely to collide with the high-pressure fuel pump 90 differ depending on the layout of the vehicle components. Thus, the protector 160 simply needs to include the wall plate 165 located between the high-pressure fuel pump 90 and the components that are likely to collide with the high-pressure fuel pump 90.

Figure 5:
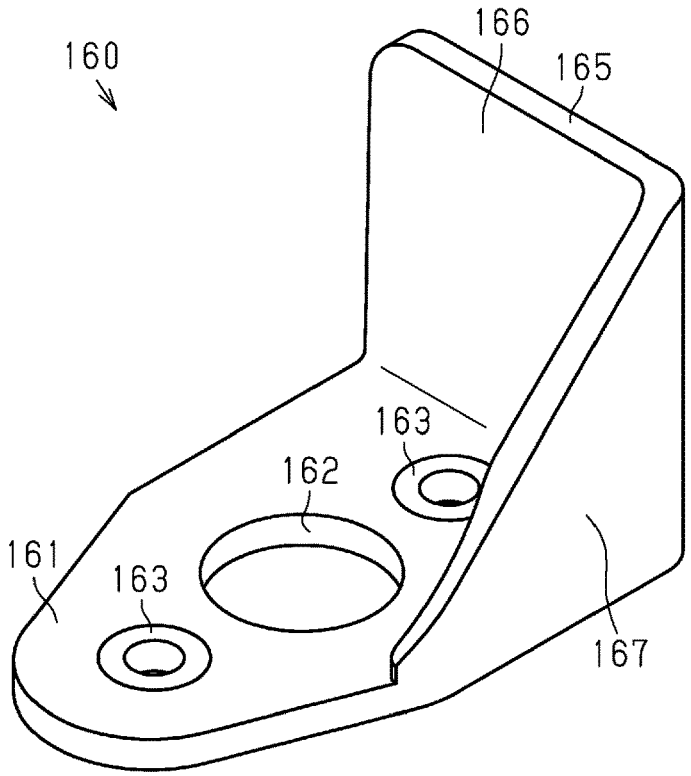
FIG. 5 is a perspective view of a protector in a modification.
Figure 6:
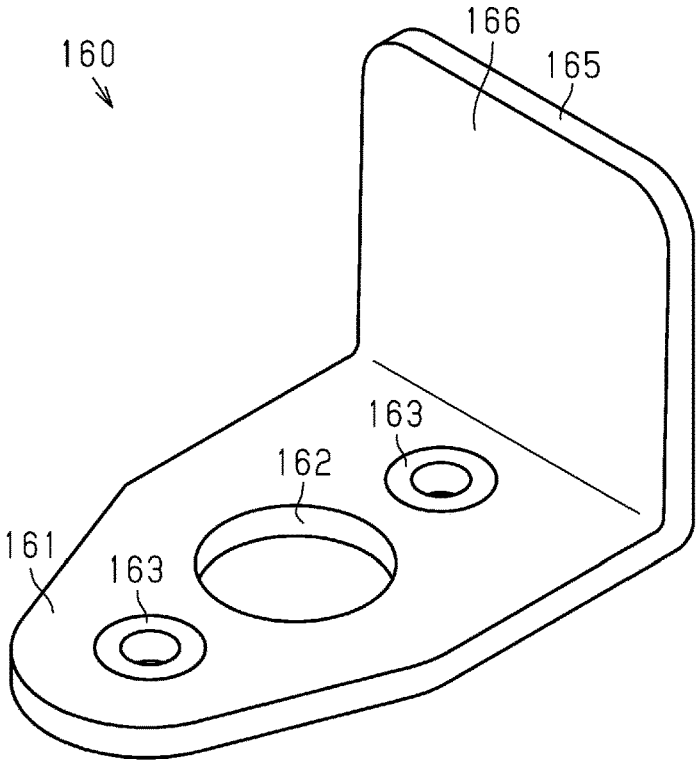
FIG. 6 is a perspective view of a protector in another modification.

In the above-described example, the wall plate 165 of the protector 160 is configured by the front wall 166, the first side wall 167, and the second side wall 168. Instead, the structure and shape of the wall plate 165 may be changed. For example, as shown in FIG. 5, the wall plate 165 may be configured by the front wall 166 and the first side wall 167 without the second side wall 168. Alternatively, as shown in FIG. 6, the wall plate 165 may be configured only by the front wall 166.

In the above-described example, the high-pressure fuel pump 90 is a plunger pump driven by the exhaust camshaft 110. However, the high-pressure fuel pump 90 does not have to be a plunger pump. Alternatively, the high-pressure fuel pump 90 may be driven by the intake camshaft 120. As another option, the high-pressure fuel pump 90 does not have to be driven by a camshaft and may be coupled to and driven by a crankshaft.

Figure 7:
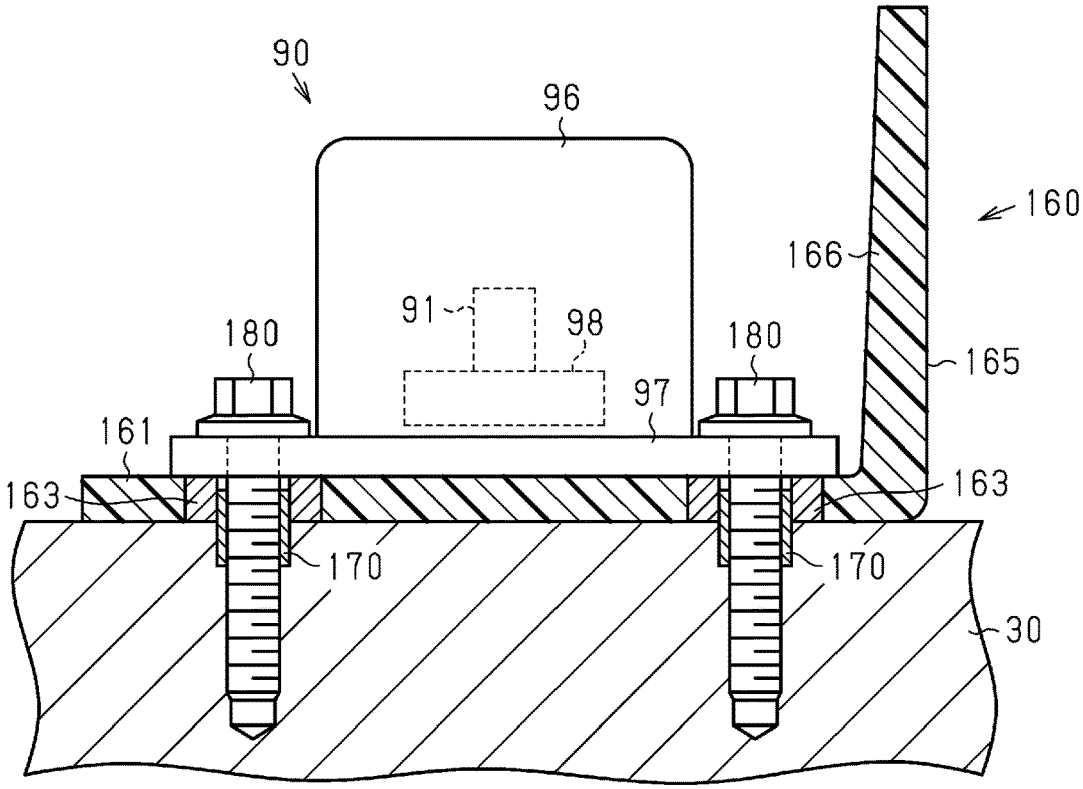
FIG. 7 is a cross-sectional view of a protector in a further modification of an internal combustion engine.
Figure 8:
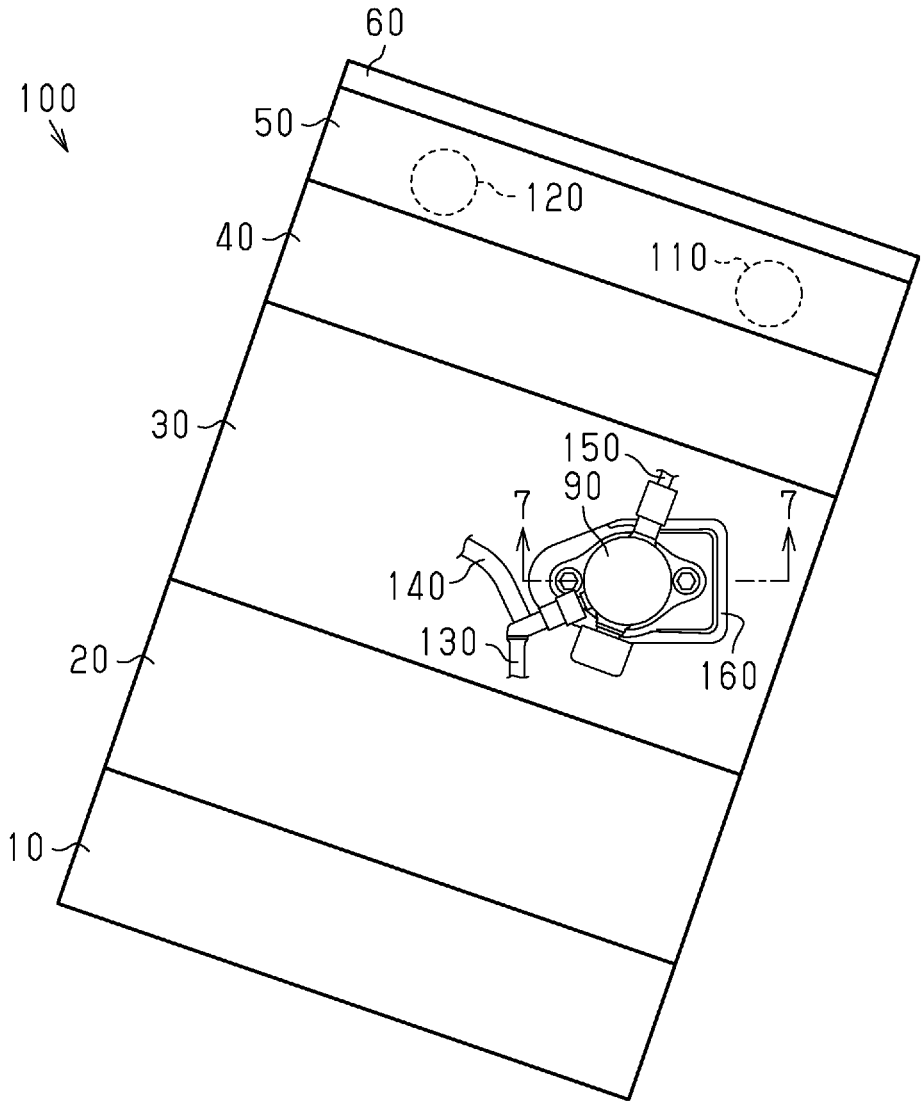
FIG. 8 is a schematic view illustrating where a high-pressure fuel pump is installed in an internal combustion engine according of the further modification shown in FIG. 7.

Further, referring to FIG. 7, the high-pressure fuel pump 90 may be an electric pump incorporating an electric actuator 98 that drives the plunger 91. That is, the high-pressure fuel pump 90 may be an electrically-driven pump. This eliminates the need for the protector 160 to have through-holes through which the plunger 91 is inserted. This also increases the positional flexibility of the engine body to which the high-pressure fuel pump 90 is coupled. For example, as shown in FIG. 8, the high-pressure fuel pump 90 may be coupled to the cylinder block 30.

The protector 160 does not have to be made of a carbon fiber reinforced plastic. For example, the protector 160 may be made of a glass fiber reinforced plastic, which is reinforced by glass fiber. Additionally, the protector 160 does not necessarily have to be made of a fiber reinforced plastic. As long as the protector 160 is made of plastic having a lower thermal conductivity than metal, the protector 160 serves as a heat-shielding layer and thus produces the same advantage as the above-described advantage (1).

The protector 160 may be configured without the metal collars 163.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An internal combustion engine comprising:

a high-pressure fuel pump;

a plastic protector including a bottom plate and a wall plate extending upward from the bottom plate; and an engine body, wherein the high-pressure fuel pump and the protector are coupled to an outer side of the engine body, the wall plate surrounds the high-pressure fuel pump to protect the high-pressure fuel pump, the high-pressure fuel pump includes a fuel chamber and a cover that surrounds the fuel chamber, wherein the cover has a flange, the engine body has a mounting surface, and the bottom plate and the flange are fastened to the mounting surface by a bolt with the bottom plate held between the flange and the mounting surface, the bottom plate has a metal collar thorough which the bolt is inserted, and a plastic portion into which the metal collar is embedded, the mounting surface is provided on a metal part of the engine body, and the metal collar and the plastic portion of the bottom plate are held between the flange and the mounting surface.

2. The internal combustion engine according to claim 1, wherein the protector is made of a fiber reinforced plastic.

3. The internal combustion engine according to claim 2, wherein the fiber reinforced plastic is a carbon fiber reinforced plastic.

4. The internal combustion engine according to claim 1, wherein the high-pressure fuel pump is a plunger pump driven by a camshaft of the internal combustion engine, the engine body includes a metal cam cap, the mounting surface is arranged on the cam cap, and the high-pressure fuel pump and the protector are fastened to the mounting surface.

5. A method for manufacturing an internal combustion engine, the method comprising:

preparing a high-pressure fuel pump including a fuel chamber and a cover that surrounds the fuel chamber, wherein a flange is arranged on the cover;

preparing a plastic protector including a bottom plate and a wall plate extending upward from the bottom plate, wherein the wall plate surrounds the high-pressure fuel pump to protect the high-pressure fuel pump, wherein the bottom plate has a metal collar though which the bolt is inserted, and a plastic portion into which the metal collar is embedded;

coupling the high-pressure fuel pump and the protector to an outer side of an engine body of the internal combustion engine;

arranging a mounting surface on the engine body, wherein the mounting surface is provided on a metal part of the engine body; and fastening the bottom plate and the flange to the mounting surface by a bolt with the bottom plate held between the flange and the mounting surface, wherein the metal collar and the plastic portion of the bottom plate are held between the flange and the mounting surface.

6. The internal combustion engine according to claim 1, wherein a diameter of the metal collar is slightly larger than a diameter of a head of the bolt.

7. The internal combustion engine according to claim 1, wherein a plunger of the high-pressure fuel pump is inserted through a through-hole of the bottom plate into a cam housing.

8. The internal combustion engine according to claim 1, wherein the plastic portion of the bottom plate has a through hole through which a plunger of the high-pressure fuel pump is inserted.

* * * * *